US008016396B2

(12) United States Patent
Kobayashi et al.

(10) Patent No.: US 8,016,396 B2
(45) Date of Patent: Sep. 13, 2011

(54) METHOD FOR MANUFACTURING LIQUID SUPPLY SYSTEM, AND LIQUID EJECTION APPARATUS

(75) Inventors: Atsushi Kobayashi, Nagano-ken (JP); Steven Chen, Taipei (TW)

(73) Assignee: Seiko Epson Corporation, Tokyo (JP)

( * ) Notice: Subject to any disclaimer, the term of this patent is extended or adjusted under 35 U.S.C. 154(b) by 577 days.

(21) Appl. No.: 11/413,555

(22) Filed: Apr. 28, 2006

(65) Prior Publication Data

US 2006/0256170 A1 Nov. 16, 2006

(30) Foreign Application Priority Data

Apr. 28, 2005 (JP) ..... 2005-133447

(51) Int. Cl.
*B41J 2/175* (2006.01)

(52) U.S. Cl. ..... 347/85

(58) Field of Classification Search ..... 347/7, 85, 347/86, 87; 141/2, 18
See application file for complete search history.

(56) References Cited

U.S. PATENT DOCUMENTS

| | | | | |
|---|---|---|---|---|
| 5,737,001 | A * | 4/1998 | Taylor | 347/85 |
| 5,967,045 | A | 10/1999 | Staiger et al. | |
| 6,048,055 | A * | 4/2000 | Hakkaku | 347/86 |
| 6,058,984 | A * | 5/2000 | Sato | 141/7 |
| 6,116,726 | A * | 9/2000 | Driggers | 347/87 |
| 6,193,364 | B1 * | 2/2001 | Iida | 347/86 |
| 6,238,042 | B1 * | 5/2001 | Kobayashi et al. | 347/86 |
| 6,474,796 | B1 * | 11/2002 | Ishinaga | 347/85 |
| 6,612,689 | B2 * | 9/2003 | Suenaga et al. | 347/85 |
| 6,908,179 | B2 * | 6/2005 | Pan et al. | 347/85 |
| 6,966,640 | B2 * | 11/2005 | Lee | 347/86 |
| 2001/0048457 | A1 | 12/2001 | Hara et al. | |
| 2002/0118242 | A1 * | 8/2002 | Tajima et al. | 347/17 |

FOREIGN PATENT DOCUMENTS

| | | | | |
|---|---|---|---|---|
| EP | 1 055 520 | | 11/2000 | |
| EP | 1 090 766 | A1 | 4/2001 | |
| EP | 1 199 178 | A1 | 4/2002 | |
| EP | 06008866.3 | | 6/2010 | |
| JP | 04187448 | * | 7/1992 | 347/86 |
| JP | 09-323430 | A | 12/1997 | |

(Continued)

OTHER PUBLICATIONS

Extended European Search Report from European patent appln. No. 06008866.3-1251 (Jan. 30, 2008).

(Continued)

*Primary Examiner* — Anh T. N. Vo
(74) *Attorney, Agent, or Firm* — Stroock & Stroock & Lavan LLP

(57) ABSTRACT

A liquid retainer support is arranged in a body of a liquid ejection apparatus in an immovable manner or in such a manner as to allow reciprocation of the liquid retainer support. A liquid retainer is secured to the liquid retainer support. A liquid retainer chamber is defined in the liquid retainer in such a manner as to allow communication between the liquid retainer chamber and the atmospheric air. A liquid supply system of the liquid ejection apparatus is manufactured by blocking the liquid retainer chamber from the atmospheric air and connecting a liquid passage defining body to the liquid retainer for supplying liquid from a liquid reservoir to the liquid retainer chamber. The liquid passage defining body includes a liquid passage that communicates with the liquid reservoir. In this manner, the cost for manufacturing the liquid supply system is reduced.

14 Claims, 3 Drawing Sheets

FOREIGN PATENT DOCUMENTS

| | | | |
|---|---|---|---|
| JP | 11-48490 | A | 2/1999 |
| JP | 2002-200771 | A | 7/2002 |
| JP | 2002-527274 | | 8/2003 |
| JP | 2004-017593 | | 1/2004 |
| JP | 2004-203055 | | 7/2004 |
| JP | 2004-262092 | A | 9/2004 |
| TW | I220668 | | 9/2004 |
| TW | M263227 | | 5/2005 |

OTHER PUBLICATIONS

Taiwanese Patent Authorization Decision from TW 095115420 (Jun. 26, 2007) (w/ complete English translation).

Japanese Patent Office Action dated Nov. 30, 2010 in JP 2005-133447.

Office Action issued on Aug. 24, 2010 in the related Japanese Patent Appln. No. 2005-133447 and the English translation thereof.

* cited by examiner

METHOD FOR MANUFACTURING LIQUID SUPPLY SYSTEM, AND LIQUID EJECTION APPARATUS

CROSS-REFERENCE TO RELATED APPLICATIONS

This application is based upon and claims the benefit of priority from prior Japanese Patent Application No. 2005-133447, filed on Apr. 28, 2005, the entire contents of which are incorporated herein by reference.

BACKGROUND

The present invention relates to methods for manufacturing liquid supply systems, and liquid ejection apparatuses.

Generally, an inkjet printer is known as a liquid ejection apparatus that ejects liquid onto a target. The printer includes a recording head located in a reciprocating carriage. Ink (liquid) is supplied from ink cartridges (liquid retainers) to the recording head. The ink is then ejected from nozzles formed in the recording head onto a recording medium, or the target, thus performing printing. More specifically, as described in Japanese Laid-Open Patent Publication No. 2004-262092, an on-carriage type inkjet printer is known. In this printer, ink cartridges are installed in a carriage. Also, as disclosed in Japanese Laid-Open Patent Publication No. 9-323430, an off-carriage type inkjet printer is known. In this printer, ink cartridges are installed at a position separate from a carriage in the printer.

In an on-carriage type printer, the space for accommodating ink cartridges in the carriage is limited. This reduces the capacity of the ink cartridges. Thus, if printing load of the printer is increased, it is necessary to replace the ink cartridges repeatedly, which is troublesome. Also, the running cost of the printer is raised. To solve this problem, the on-carriage type printer may be modified to an off-carriage type by connecting an external large-capacity ink tank to the ink cartridges, which are received in the carriage.

However, as in the off-carriage type printer of Japanese Laid-Open Patent Publication No. 9-323430, the ink cartridges are connected to the recording head through ink supply tubes. Ink is thus supplied from the ink cartridges to the recording head through the ink supply tubes. Normally, a damper is arranged between the downstream end of each ink supply tube and the recording head for absorbing rocking of the ink, which is caused by reciprocation of the carriage.

Thus, when connecting the external ink tank to the on-carriage type printer to modify the printer to the off-carriage type, the dampers must be removed from the original locations and reinstalled at the ink cartridges, which are accommodated in the carriage. When any of the ink cartridges becomes empty, that ink cartridge is discarded together with the damper. The damper is thus wasted. This also makes it necessary to install a replacement damper in the printer, which increases costs.

SUMMARY

An advantage of some aspect of the present invention is to provide a method for inexpensively manufacturing a liquid supply system and a liquid ejection apparatus including a liquid supply system that is manufactured by the method.

A first aspect of the invention provides a method for manufacturing a liquid supply system of a liquid ejection apparatus. A liquid retainer support is immovably arranged in a body of the liquid ejection apparatus. A liquid retainer is secured to the liquid retainer support. A liquid retainer chamber is defined in the liquid retainer in such a manner as to allow communication between the liquid retainer chamber and the atmospheric air. The method includes: blocking the liquid retainer chamber from the atmospheric air; and connecting a liquid passage defining body having a liquid passage communicating with a liquid reservoir to the liquid retainer for supplying liquid from the liquid reservoir to the liquid retainer chamber.

A second aspect of the invention provides a method for manufacturing a liquid supply system of a liquid ejection apparatus. A liquid retainer support is arranged in a body of the liquid ejection apparatus in such a manner as to allow reciprocation of the liquid retainer support. A liquid retainer is secured to the liquid retainer support. A liquid retainer chamber is defined in the liquid retainer in such a manner as to allow communication between the liquid retainer chamber and the atmospheric air. The method includes: blocking the liquid retainer chamber from the atmospheric air; and connecting a liquid passage defining body having a liquid passage communicating with a liquid reservoir to the liquid retainer for supplying liquid from the liquid reservoir to the liquid retainer chamber.

A third aspect of the invention provides a liquid ejection apparatus having a liquid supply system manufactured by any one of the above methods for manufacturing a liquid supply system.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

Figure 1A:
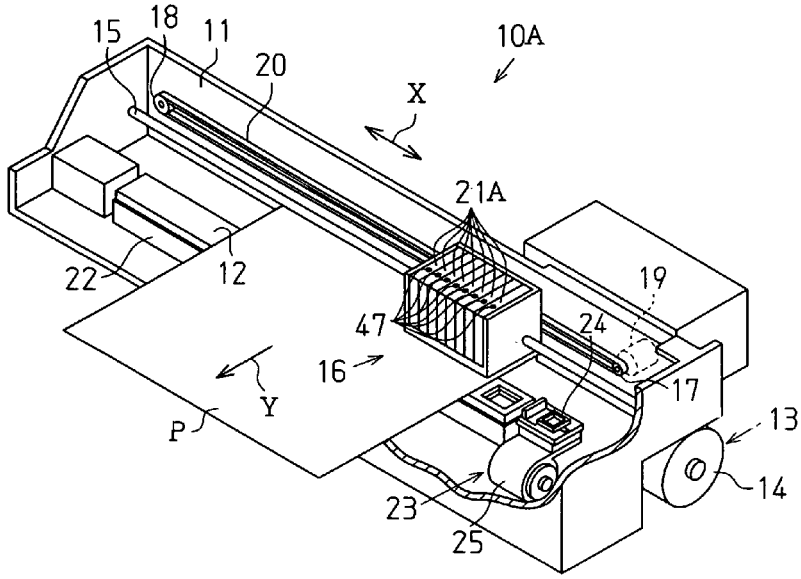
FIG. 1A is a partially exploded perspective view showing a printer before modification.
Figure 1B:
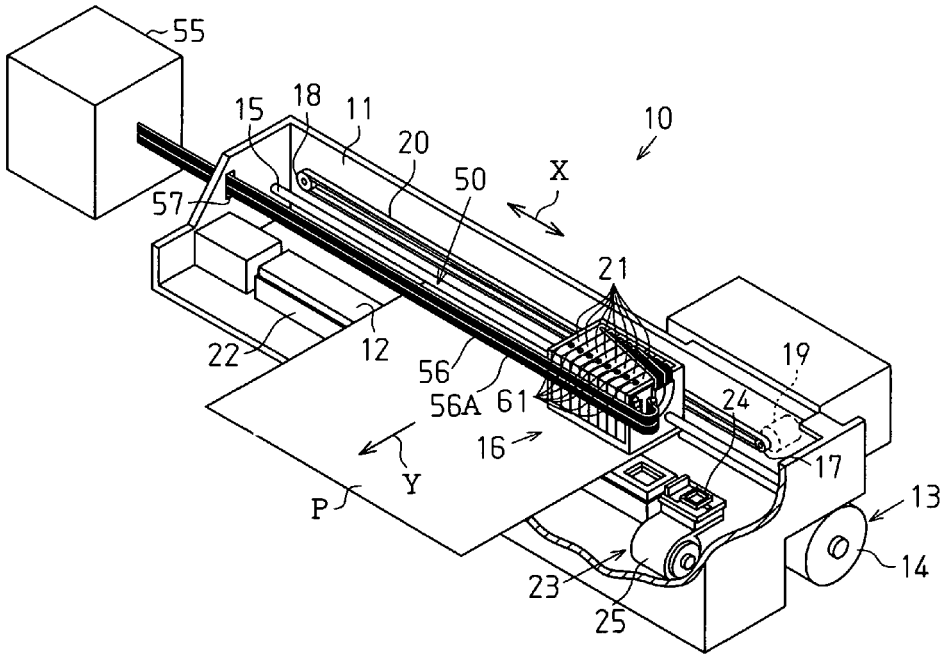
FIG. 1B is a partially exploded perspective view showing a printer according to an embodiment of the present invention, which is obtained by modifying the printer of FIG. 1A.

An embodiment of the present invention will now be described with reference to FIGS. 1A to 2B. FIG. 1A is a partially exploded perspective view showing an on-carriage type printer 10A. FIG. 1B is a partially exploded perspective view showing an off-carriage type printer 10, which is a liquid ejection apparatus according to the present invention. The off-carriage type printer 10 is obtained by modifying the on-carriage type printer 10A. In the following, the configuration of the on-carriage type printer 10A, the configuration of the off-carriage type printer 10, and a method for modifying the on-carriage type printer 10A (a method for fabricating a liquid supply system) will be explained in this order.

As shown in FIG. 1A, the printer 10A has a substantially box-like frame 11, or a printer body. A platen 12 is provided in a lower part of the space defined in the frame 11 and extends in a longitudinal direction of the frame 11 (a main scanning direction X of FIG. 1A). The platen 12 functions as a support table that supports a sheet of paper P, or a target, and is driven by a paper feeder motor 14 provided in a paper feeder mechanism 13. The platen 12 thus sends the paper sheet P in a sub scanning direction Y perpendicular to the main scanning direction X. In the following description, the terms regarding directions such as "forward", "rearward", "leftward", "rightward", "upward", and "downward" are defined with respect to the sub scanning direction Y. Specifically, the point of the arrow of the subscanning direction Y is assumed to be facing forward, and the other directions are defined relative to the direction of the arrow.

A guide shaft 15 is arranged in the frame 11 and above the platen 12. The guide shaft 15 is passed through and movably supported by a carriage 16, or a liquid retainer support. A drive pulley 17 and a driven pulley 18 are rotatably supported by an inner surface of the frame 11 at positions corresponding to opposing ends of the guide shaft 15. A carriage motor 19 is connected to the drive pulley 17. A timing belt 20 is wound around the pulleys 17, 18, thus securely supporting the carriage 16. While driven by the carriage motor 19 and guided by the guide shaft 15, the carriage 16 is movable in the main scanning direction X through the timing belt 20.

A recording head (not shown) is formed on a lower surface of the carriage 16 as a liquid ejection head. A plurality of nozzles (not shown) are defined in a lower surface of the recording head. A plurality of (eight, in the illustrated embodiment) ink cartridges 21A, or liquid retainers, are removably received in the carriage 16 and located above the recording head. Each of the ink cartridges 21A is filled with a corresponding one of eight types, which are deep magenta, light magenta, deep cyan, light cyan, deep yellow, light yellow, deep black, and light black inks. A piezoelectric element (not shown) is provided in the recording head. Through excitement of the piezoelectric element, the color inks are supplied from the corresponding ink cartridges 21A to the recording head. The inks are then ejected from the nozzles onto the paper sheet P supported by the platen 12, thus performing printing.

Referring to FIG. 1A, a waste tank 22 is arranged in the frame 11 and below the platen 12, extending parallel with the platen 12. The waste tank 22 accommodates an absorber (not shown), which is formed of, for example, porous pulp material. A cleaning mechanism 23 is provided at an end of the printer 10A (the right end as viewed in FIG. 1A), which is a non-ejection area in which the paper sheet P does not enter. The cleaning mechanism 23 includes a cap 24 that seals the recording head and a suction pump 25, or suction means (a suction mechanism), thus drawing the ink from the nozzles to prevent clogging of the nozzles.

Figure 2A:
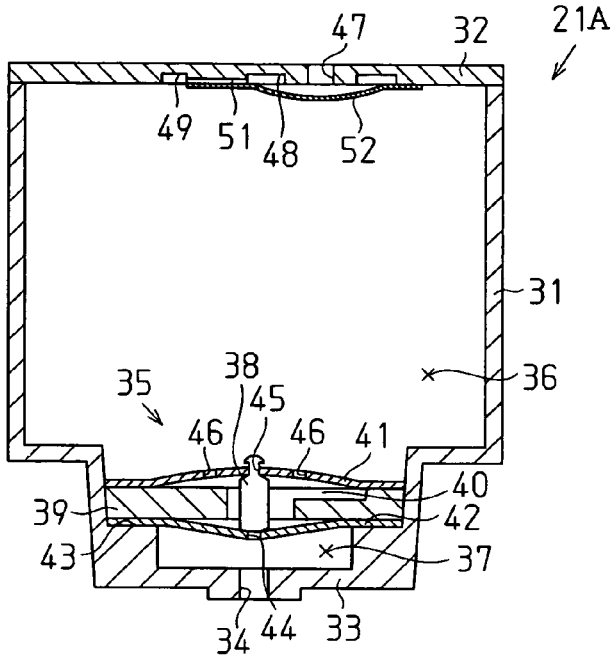
FIG. 2A is a cross-sectional view showing an ink cartridge installed in the printer of FIG. 1A.

FIG. 2A is a cross-sectional view showing the ink cartridge 21A, which is installed in the carriage 16 of the printer 10A. As shown in FIG. 2A, the ink cartridge 21A has a substantially parallelepiped container 31 having an upper opening and a lid member 32 that seals the upper opening of the container 31. An ink supply port 34 is defined substantially at the center of a bottom 33 of the container 31. An ink supply needle (not shown) provided in the recording head is passed through the ink supply port 34. A differential pressure regulating valve 35 is formed in a lower part of the space in the container 31. The space is thus divided into an ink retainer chamber 36, or a liquid retainer chamber, and an ink supply chamber 37 with respect to the differential pressure regulating valve 35. The ink retainer chamber 36 is located above the differential pressure regulating valve 35 and the ink supply chamber 37 is located below the differential pressure regulating valve 35.

The differential pressure regulating valve 35 has a valve body 38, a valve assembly body 39, a valve body support film 41, and a film valve seat 42. The film valve seat 42 is formed by an elastic film exhibiting improved durability with respect to ink, such as a rubber film or a high-molecule elastomer film. The film valve seat 42 is secured to a step 43 formed in the lower part of the space in the container 31. A through hole 44 extends through the center of the film valve seat 42.

The valve body support film 41 supports the valve body 38 through a through hole 45, which is defined at the center of the valve body support film 41. Specifically, the valve body support film 41 constantly urges the valve body 38 to contact the film valve seat 42 and prevents the valve body 38 from lowering exceeding a certain level. The valve body support film 41 is formed of the same material as the film valve seat 42 and secured to an upper surface of the valve assembly body 39. Through holes 46, through which the ink passes, are defined in the valve body support film 41 at opposing sides of the valve body 38 and in the vicinity of the valve body 38.

A through hole 40 (an ink passage) is defined in the valve assembly body 39. The valve body 38 is received in the through hole 40 in a manner movable upward or downward. In this state, the valve body 38 is supported by the valve body support film 41. The vertical length of the valve body 38 is slightly greater than the thickness of the valve assembly body 39. A lower end of the valve body 38 blocks a through hole 44 that is defined in the film valve seat 42. The film valve seat 42, the valve body support film 41, and the valve body 38 are assembled with the valve assembly body 39 as an integral body. The assembled body is fitted in the step 43 of the container 31 and thus incorporated in the container 31 as the differential pressure regulating valve 35.

An air hole 47 is defined in the lid member 32. A recess 48, a communication port 49, and a narrow groove 51 are provided in the backside of the lid member 32 (a side facing the ink retainer chamber 36). The air hole 47 is encompassed by the wall of the recess 48. The communication port 49 is spaced from the recess 48 by a certain distance. The narrow groove 51 connects the recess 48 to the communication port 49. A flexible film 52 is secured to a portion of the backside of the lid member 32 corresponding to the air hole 47, the recess 48, and the narrow groove 51. In this state, the flexible film 52 is slightly deformed and thus separated from the air hole 47 by a slight distance. The flexible film 52 is formed of air-permeable material that is permeable to gases (air) but not to liquids (ink). Thus, even if the ink cartridge 21A is inclined and the ink proceeds toward the air hole 47 in the ink retainer chamber 36, undesired ink leakage from the air hole 47 does not occur.

When ink is discharged from the recording head, the ink is sent from the ink supply chamber 37 of the ink cartridge 21A to the recording head through the ink supply port 34. This gradually decreases the pressure in the ink supply chamber 37, deforming the film valve seat 42 in a manner extending downward. The valve body 38 and the valve body support film 41 are thus lowered correspondingly. As the ink continuously flows from the ink supply chamber 37 and the film valve seat 42 deforms correspondingly, the valve body 38 separates from the film valve seat 42, thus opening the through hole 44. This connects the ink retainer chamber 36 to the ink supply chamber 37, and the ink is supplied to the ink supply chamber 37.

The configuration of the printer 10 according to the illustrated embodiment, or the modified printer 10A, will hereafter be described. Unlike the printer 10A, the printer 10 includes a large-capacity ink tank 55 connected to an ink supply tube 56, as will be explained later. Further, an ink cartridge 21 of the printer 10 has a lid member 32 configured differently from the lid member 32 of the ink cartridge 21A of the printer 10A. The following description focuses on such differences between the printer 10 and the printer 10A.

As shown in FIG. 1B, the printer 10 of the illustrated embodiment includes the large-capacity ink tank 55, or a liquid reservoir, which is provided outside the frame 11 (at the left side of the frame 11, as viewed in the drawing). The large-capacity ink tank 55 receives eight large-capacity ink packs (not shown). The large-capacity ink packs receive different color inks in correspondence with the ink cartridges 21, which are installed in the carriage 16 and function as dampers. The large-capacity ink tank 55 is connected to the ink cartridges 21 through an ink supply tube 56, or a liquid passage defining body.

The ink supply tube 56 is formed of, for example flexible material such as polyethylene and introduced into the frame 11 through an insertion hole 57, which is defined in the frame 11. The ink supply tube 56 is thus connected to the carriage 16 (the ink cartridges 21). A plurality of (eight, in this embodiment) ink passages 56*a* (see FIG. 2B), or liquid passages, are defined in the ink supply tube 56 in correspondence with the ink packs received in the large-capacity ink tank 55. In other words, the ink supply tube 56 includes a plurality of (eight, in this embodiment) tube bodies 56A, which are formed as an integral body. Each of the tube bodies 56A is connected to the corresponding one of the ink cartridges 21. An ink passage 56*a* is defined in each tube body 56A.

Hereinafter, an end of the ink supply tube 56 corresponding to the large-capacity ink tank 55 is defined as an upstream end while an opposing end of the ink supply tube 56 corresponding to the ink cartridges 21 is defined as a downstream end. The upstream end of the ink supply tube 56 is connected to the large-capacity ink tank 55. Each of the ink passages 56*a* communicates with the corresponding one of the ink packs received in the large-capacity ink tank 55. The downstream end of the ink supply tube 56 is connected to the ink cartridges 21 in the carriage 16. Each ink passage 56*a* thus communicates with the corresponding ink cartridge 21, which retains the corresponding color ink. The color inks are thus sent from the large-capacity ink tank 55 to the ink cartridges 21 through the corresponding ink passages 56*a* of the ink supply tube 56. The inks are then supplied from the ink cartridges 21 to the corresponding nozzles (not shown) of the recording head (not shown), which is formed in the lower surface of the carriage 16. In the illustrated embodiment, the large-capacity ink tank 55, the ink supply tube 56, and the ink cartridges 21 define an ink supply system 50, or a liquid supply system.

Figure 2B:
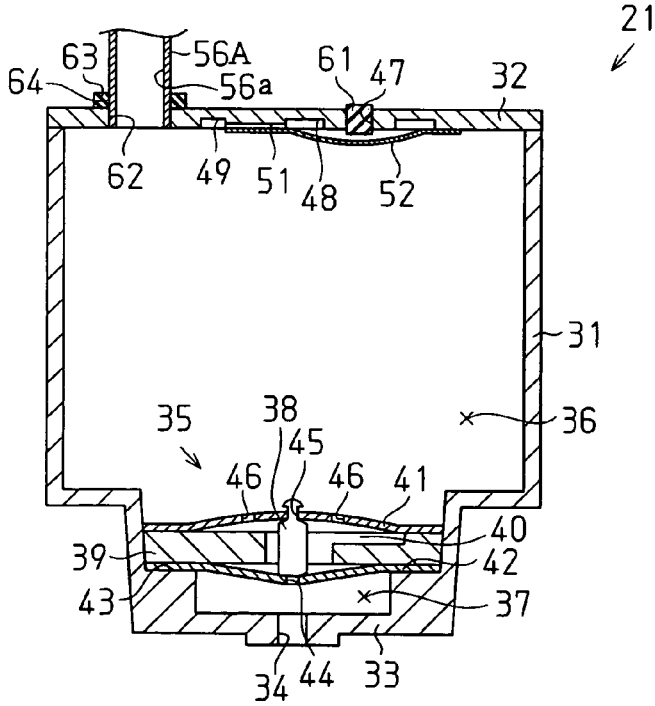
FIG. 2B is a cross-sectional view showing an ink cartridge installed in the printer of FIG. 2A.

The configuration of each ink cartridge 21, the modified ink cartridge 21A, will now be explained. FIG. 2B is a cross-sectional view showing the ink cartridge 21, which is installed in the carriage 16 of the printer 10. The ink cartridge 21 is different from the ink cartridge 21A in the structure of the lid member 32. The following explanation thus focuses on the difference between the lid member 32 of the ink cartridge 21 and the lid member 32 of the ink cartridge 21A.

As shown in FIG. 2B, an elastic member 61 formed of rubber is fitted in the air hole 47 extending through the lid member 32 of the ink cartridge 21. A connection bore 62 is defined in the lid member 32 at a position spaced from the portion of the backside of the lid member 32 to which the flexible film 52 is applied. The corresponding tube body 56A is connected to the ink cartridge 21 through the connection bore 62. Specifically, a silicone rubber ring 63 is arranged around a downstream end of the tube body 56A. The downstream end of the tube body 56A is thus securely fitted in the connection bore 62. That is, by tightly contacting the ink cartridge 21 and the tube body 56A, the ring 63 maintains a joint portion between the ink cartridge 21 and the tube body 56A in a sealed state.

Next, the method for obtaining the printer 10 by modifying the printer 10A (the method for manufacturing the ink supply system 50) will be explained.

First, the elastic member 61 is fitted in the air hole 47 of the ink cartridge 21A of FIG. 2A, which is installed in the carriage 16 of the on-carriage type printer 10A of FIG. 1A. The air hole 47 is thus closed, and the ink retainer chamber 36 is blocked from the atmospheric air (a blocking step). The upstream end (an end) of the ink supply tube 56 is connected to the large-capacity ink tank 55. The downstream end (an opposing end) of the ink supply tube 56 is inserted into the printer 10 through the insertion hole 57 of the frame 11. In the printer 10, the ink supply tube 56 is arranged in a manner extending along a front surface of the carriage 16 (in a direction parallel with the front surface of the carriage 16) and in a movement direction of the carriage 16 (in a rightward direction as viewed in FIG. 1). The ink supply tube 56 is then held by a right side surface of the carriage 16 and passed to an upper surface of the carriage 16.

Subsequently, the connection bore 62 is provided in the lid member 32 of each ink cartridge 21A. The silicone rubber ring 63 is arranged around the downstream end of each tube body 56A of the ink supply tube 56. The downstream end of the tube body 56A is then fitted in the connection bore 62, thus connecting the tube body 56A to the ink cartridge 21A that retains the corresponding color ink (a connection step). This causes the ring 63 to seal the joint portion 64 between the ink cartridge 21A and the tube body 56A (a sealing step). In this manner, the ink cartridge 21A of FIG. 2A is modified to the ink cartridge 21 of FIG. 2B.

In the printer 10 of the illustrated embodiment, each of the ink cartridges 21 functions as a sub tank, and the large-capacity ink tank 55, which is an additional component to the printer 10A, functions as a liquid supply source (a liquid reservoir). In other words, the ink is supplied from the large-capacity ink tank 55 to the ink cartridges 21 through the corresponding ink passages 56*a* of the ink supply tube 56. The ink is thus supplied to the corresponding nozzles (not shown) of the recording head (not shown), which is formed on the lower surface of the carriage 16, through the ink cartridges 21. This permits the printer 10 to perform printing in accordance with increased printing load. Further, the ink cartridge 21 includes the differential pressure regulating valve 35 and thus retains a predetermined amount of ink in the container 31. The ink cartridge 21 thus functions as a damper that absorbs rocking of the ink caused by reciprocation of the carriage 16.

The illustrated embodiment has the following advantages.

In the illustrated embodiment, the ink supply system 50, which is an off-carriage type, is manufactured based on the ink cartridge 21A, which is installed in the carriage 16 of the on-carriage type printer 10A. The ink supply system 50 is applicable to operation of the printer 10 with increased printing load. In accordance with the method of the illustrated embodiment, the ink cartridges 21A of the on-carriage type printer 10A can be modified to the ink cartridges 21 of the off-carriage type printer 10, which function as dampers. This reduces the manufacturing cost of the ink cartridges 21.

In the illustrated embodiment, each ink cartridge 21 (21A) of the printer 10 (10A) has the differential pressure regulating valve 35, which is formed in the container 31. The predetermined amount of the ink is thus maintained in the container 31. Therefore, unlike an ink cartridge in which a porous foamed body is arranged, the ink moves smoothly in the container 31. This permits the ink cartridge 21, which is modified from the ink cartridge 21A, to effectively function as a damper. The ink cartridge 21 thus absorbs rocking of the ink caused by reciprocation of the carriage 16 of the printer 10, stably supplying a predetermined amount of ink to the recording head.

In the illustrated embodiment, the silicone rubber ring 63, which is arranged around the downstream end of each tube body 56A of the ink supply tube 56, seals the joint portion 64 between the tube body 56A and the corresponding ink cartridge 21. This prevents the ink from leaking or evaporating through the joint portion 64 even when the carriage 16 is reciprocating.

In the blocking step of the illustrated embodiment, the elastic member 61, which is formed of rubber, is fitted in the air hole 47 of each ink cartridge 21. Through such simple operation, the ink retainer chamber 36 of the ink cartridge 21 is blocked from the atmospheric air.

In the illustrated embodiment, the large-capacity ink tank 55 is provided outside the frame 11. This ensures a sufficient amount of ink for printing by the printer 10, thus permitting the printer 10 to effectively operate in accordance with increased printing load.

The illustrated embodiment may be modified as follows.

The large-capacity ink tank 55 may be arranged inside the frame 11, not outside the frame 11.

Figure 3:
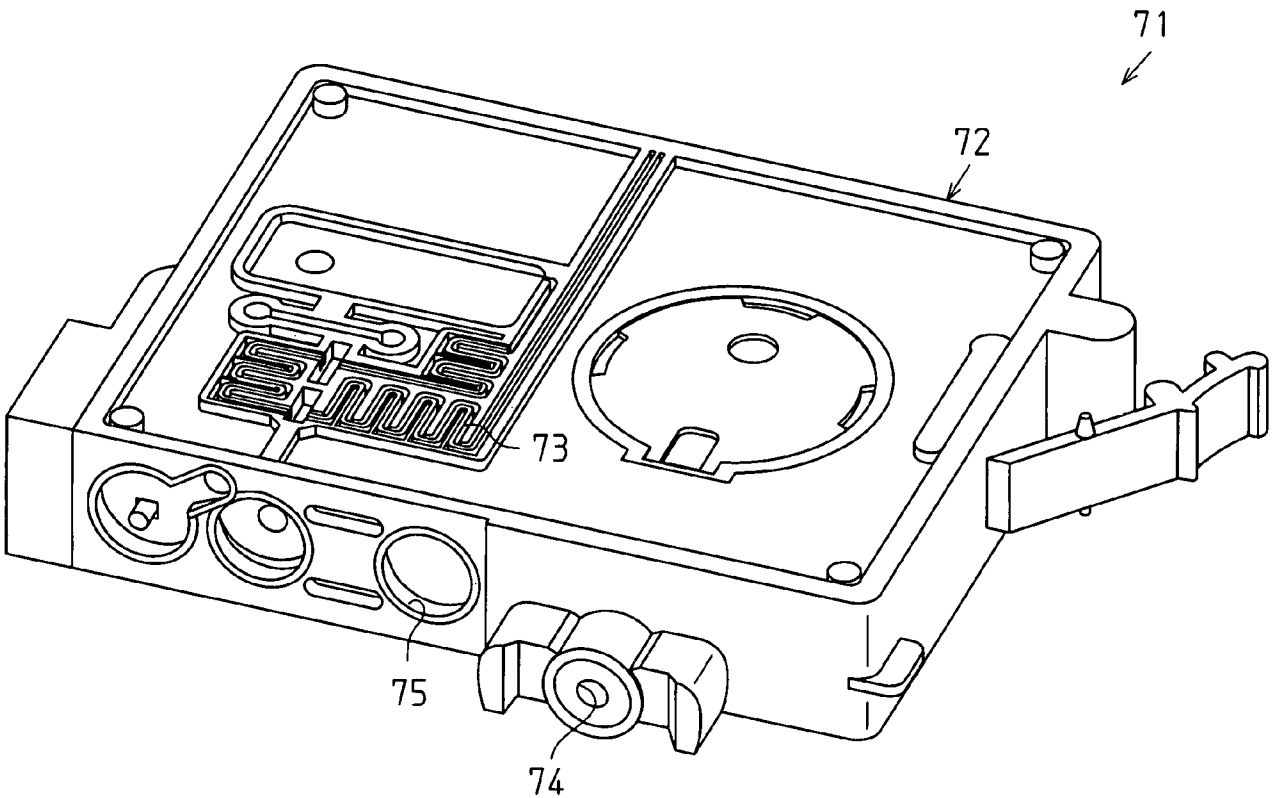
FIG. 3 is a perspective view showing an ink cartridge according to another embodiment of the present invention.

Instead of the ink cartridge 21A shown in FIG. 2A, an ink cartridge 71 of FIG. 3 may be modified in accordance with the method of the illustrated embodiment. The ink cartridge 71 is installed in a carriage of an on-carriage type printer and includes a cartridge body 72. Although films are applied to opposing sides of the cartridge body 72, the films are omitted in FIG. 3 for the illustrative purposes.

Referring to FIG. 3, an air passage 73 is defined in the backside of the cartridge body 72 of the ink cartridge 71 and extends in a meandering manner. An end of the air passage 73 is arranged in the vicinity of an upper surface of the cartridge body 72, thus exposing the air passage 73 to the atmospheric air. An opposing end of the air passage 73 is connected to an ink retainer chamber (not shown) defined in the cartridge body 72. A plurality of valve chambers each including a retainer chamber and a differential pressure regulating valve are provided in the cartridge body 72. An ink supply port 74 is defined in a lower surface of the ink cartridge 71. The ink is thus gradually supplied to the recording head through the ink supply port 74. An ink refill port 75 is also defined in the lower surface of the ink cartridge 71. Thus, by performing refill of the ink in the ink retainer chamber through the ink refill port 75, the ink cartridge 71 can be used for not only once but for multiple times.

In modification of the ink cartridge 71 of FIG. 3 to the damper of the off-carriage type printer 10, the blocking step for blocking the ink retainer chamber from the atmospheric air is completed by sealing an intermediate portion or a distal end (or an air hole) of the air passage 73. Specifically, such sealing may be performed by pouring adhesive in the air passage 73 or the air hole or through thermal welding or by other suitable methods. These sealing methods using the adhesive or the thermal welding is also applicable to sealing of the air hole 47 of the illustrated embodiment. Further, if the blocking step is carried out by these methods, use of an additional component such as the elastic member 61 becomes unnecessary, which is advantageous.

Alternatively, in an ink cartridge including a valve for exposing an ink retainer chamber to the atmospheric air, the ink retainer chamber can be blocked from the atmospheric air by maintaining the valve in a closed state.

The joint portion 64 between each ink cartridge 21 and the corresponding tube body 56A of the ink supply tube 56 may be sealed by, for example, adhesive.

In the illustrated embodiment, the liquid retainer support is embodied as the carriage 16. However, the liquid retainer support may be embodied as an elongated head having more nozzles than the recording head of the embodiment. The elongated head is immovably provided above the platen 12. Also in this case, using a liquid retainer installed in the liquid retainer support (the elongated head), a liquid supply system applicable to operation with increased printing load is reliably provided.

In the above illustrated embodiment, the present invention is applied to the printer 10, which ejects ink. However, the present invention may be applied to other types of liquid ejection apparatuses. For example, the present invention may be applied to printing machines including fax machines and copy machines, a liquid injecting apparatus for injecting liquid such as electrode material or color material used for manufacturing liquid crystal displays, electro luminescent displays and surface light emitting displays. The present invention may also be applied to liquid injecting apparatus for injecting biological organic matter used for manufacturing biochips. Alternatively, the present invention may be applied to sample injecting apparatus such as a precision pipette. Also, the present invention may be applied to devices that use liquid other than ink.

What is claimed is:

1. A method for manufacturing a liquid supply system for supplying liquid stored in a liquid reservoir, which is arranged outside a body of a liquid ejection apparatus, to the liquid ejection apparatus, in a state where the liquid reservoir is connected to a liquid retainer that is installed in the liquid ejection apparatus, wherein the liquid reservoir remains connected to the liquid retainer when the liquid ejection apparatus ejects the supplied liquid, a liquid retainer chamber being defined in the liquid retainer in such a manner as to allow communication between the liquid retainer chamber and atmospheric air when the retainer is in an unblocked condition, the method comprising:

providing the liquid ejection apparatus having the liquid retainer thereon, the liquid retainer including a liquid retainer chamber and a selectively blockable air hole which, in the unblocked condition, permits atmospheric air to communicate with the liquid retainer chamber but in the blocked condition, blocks atmospheric air from communicating with the liquid retainer chamber, the liquid ejection apparatus and liquid retainer adapted to supply and eject liquid from the liquid retainer when the air hole is in the unblocked condition;

blocking the liquid retainer chamber from communicating with the atmospheric air by blocking the air hole; and connecting the liquid retainer to a liquid passage defining body having a liquid passage communicating with the liquid reservoir which is outside the body of the liquid ejection apparatus, wherein the liquid retainer chamber remains blocked from the atmospheric air whenever the liquid ejection apparatus ejects the liquid while liquid is being supplied from the liquid reservoir to the liquid retainer, for ejection by the liquid ejection apparatus.

2. The method according to claim 1, wherein the connecting of the liquid retainer to the liquid passage defining body includes sealing a joint portion between the liquid retainer and the liquid passage defining body.

3. The method according to claim 2, wherein the sealing of the joint portion is performed by using an adhesive.

4. The method according to claim 1, wherein the blocking of the liquid retainer chamber from the atmospheric air is performed by fitting an elastic member in the air hole.

5. The method according to claim 1, wherein the liquid retainer includes an air passage communicating the air hole with the liquid retainer chamber and the blocking of the liquid retainer chamber from the atmospheric air is performed by sealing the air hole or the air passage by thermal welding, the air passage communicating the air hole with the liquid retainer chamber.

6. A liquid supply system manufactured by the method according to claim 1.

7. The method according to claim 1, wherein the liquid retainer is installed in a liquid retainer support, the liquid retainer support being arranged in the body of the liquid ejection apparatus in such a manner as to allow reciprocation of the liquid retainer support.

8. The method according to claim 1, wherein the liquid retainer comprises:

the liquid retainer chamber;

the air hole that allows communication between the liquid retainer chamber and the atmospheric air;

a liquid supply port for supplying liquid from the liquid retainer chamber to the liquid ejection apparatus; and a valve that divides the liquid retainer chamber into a liquid supply chamber and the remainder of the liquid retainer chamber, the liquid supply chamber communicating with the liquid supply port, wherein the valve allows the remainder of the liquid retainer chamber to communicate with the liquid supply chamber when the pressure in the liquid supply chamber is decreased.

9. The method according to claim 1, wherein the connecting of the liquid retainer to the liquid passage defining body includes:

providing a connection bore in the liquid retainer; and fitting the liquid passage defining body in the connection bore.

10. The method according to claim 1, wherein the liquid retainer includes an air passage communicating the air hole with the liquid retainer chamber and the blocking of the liquid retainer chamber from the atmospheric air is performed by applying an adhesive to the air hole or the air passage.

11. The method according to claim 1, wherein the air hole includes a valve and the blocking of the liquid retainer chamber from the atmospheric air is performed by closing the valve.

12. The method according to claim 1, wherein the liquid retainer is installed in a liquid retainer support, the liquid retainer support being arranged in the body of the liquid ejection apparatus in such a manner as to prevent movement of the liquid retainer support.

13. The method according to claim 1, wherein the liquid reservoir stores a plurality of different liquids, wherein the liquid retainer is one of a plurality of liquid retainers that are installed in the liquid ejection apparatus, wherein the liquid passage is one of a plurality of liquid passages that are included in the liquid passage defining body, wherein the blocking of the liquid retainer chamber from the atmospheric air includes blocking the liquid retainer chambers of the liquid retainers from the atmospheric air, and wherein the connecting of the liquid retainer to the liquid passage defining body includes connecting each liquid passages of the liquid passage defining body to corresponding one of the liquid retainers for supplying each liquid stored in the liquid reservoir to the liquid retainer chamber of corresponding one of the liquid retainers.

14. The method according to claim 1, wherein the air hole is blocked before the liquid reservoir is coupled to the liquid retainer with the liquid passage defining body.

* * * * *